US008535456B2

(12) United States Patent
Ishii et al.

(10) Patent No.: US 8,535,456 B2
(45) Date of Patent: Sep. 17, 2013

(54) CHEMICAL CONVERSION TREATMENT SOLUTION FOR A STEEL MATERIAL AND CHEMICAL CONVERSION TREATMENT METHOD

(75) Inventors: Hitoshi Ishii, Kanagawa (JP); Yasuhiko Nagashima, Kanagawa (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 337 days.

(21) Appl. No.: 13/004,678

(22) Filed: Jan. 11, 2011

(65) Prior Publication Data

US 2011/0100830 A1 May 5, 2011

Related U.S. Application Data

(63) Continuation of application No. PCT/JP2008/062608, filed on Jul. 11, 2008.

(51) Int. Cl.
*C23C 22/34* (2006.01)
*C23C 22/00* (2006.01)

(52) U.S. Cl.
USPC ..... 148/247; 148/274; 106/14.11; 106/14.15; 106/14.17; 106/14.41; 106/14.42; 106/14.44

(58) Field of Classification Search
USPC ..... 148/247, 274; 106/14.11, 14.15, 106/14.37, 14.41, 14.42, 14.44
See application file for complete search history.

(56) References Cited

FOREIGN PATENT DOCUMENTS

| | | |
|---|---|---|
| JP | 8-60380 | 3/1996 |
| JP | 2001-348674 | 12/2001 |
| JP | 2002-363488 | 12/2002 |
| JP | 2004-218070 | 8/2004 |
| JP | 2004-218074 | 8/2004 |
| JP | 2006-336106 | 12/2006 |

*Primary Examiner* — Lois Zheng
(74) *Attorney, Agent, or Firm* — Mary K. Cameron

(57) ABSTRACT

A chemical conversion treatment solution for a steel material is provided. The solution is an acidic aqueous solution of pH 3 to 5 containing 50 to 500 ppm by weight of zirconium fluoride complex in terms of Zr, 5 to 50 ppm by weight of free fluorine, and 5 to 30% by weight in relation to Zr of polyethyleneimine having a weight average molecular weight of 300 to 10,000, a molar ratio of the primary amino group of at least 30%, and a molar ratio of the tertiary amino group of at least 15% in relation to the total amino group content. A method for chemical conversion treatment is also provided. This invention realizes excellent coating adhesion and corrosion resistance after the coating, as well as improved throwing power in the coating, and in particular, in the electrodeposition coating of a steel material.

8 Claims, 2 Drawing Sheets

CHEMICAL CONVERSION TREATMENT SOLUTION FOR A STEEL MATERIAL AND CHEMICAL CONVERSION TREATMENT METHOD

TECHNICAL FIELD

This invention relates to a chemical conversion treatment solution for a steel material which is capable of realizing excellent coating adhesion as well as high corrosion resistance after the coating. This invention also relates to a method for conducting the chemical conversion treatment.

BACKGROUND ART

Conventional well-known methods for providing corrosion resistance and coating adhesion with the steel material include zinc phosphate treatment and zirconium-based chemical conversion treatment.

The zinc phosphate treatment has been used for a long time as a chemical conversion treatment for a steel material. This zinc phosphate treatment is effective not only for the steel material but also for zinc-based materials and aluminum alloy materials. However, the solution used for the zinc phosphate treatment contains as its main component phosphorus which is a eutrophication element or nickel with the risk of carcinogenicity. In addition, this process is associated with the generation of a considerable amount of sludge. Accordingly, use of the zinc phosphate treatment is less favored in these days for environmental reasons.

In contrast, the zirconium-based chemical conversion treatment has recently received attention as a substitute for the zinc phosphate treatment since this method can be carried out with reduced environmental load. However, this method is originally a technique which as been used for an aluminum alloy material, and accordingly, it has been difficult to realize a sufficient coating weight on a steel material, and also, the coating adhesion and the corrosion resistance after the coating were not of the level realized in the zinc phosphate treatment. In view of such situation, various improvements have been proposed.

Exemplary improvements of the zirconium-based chemical conversion treatment for a steel material include the following Patent Literatures.

Patent Literature 1 discloses a chemical conversion agent comprising at least one member selected from zirconium, titanium, and hafnium, fluorine, and a water soluble resin wherein the water soluble resin comprises a constitutional unit represented by the following formula (1):

[Chemical formula 1]

(1)

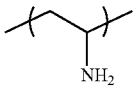

and/or the following formula (2):

[Chemical formula 2]

(2)

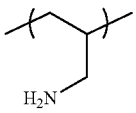

in at least a part thereof.

Patent Literature 2 discloses a coating pretreatment comprising at least one member selected from the group consisting of zirconium, titanium, and hafnium, fluorine, and at least one member selected from the group consisting of an amino group-containing silane coupling agent, its hydrolysate, and its polymerization compound.

Such zirconium-based chemical conversion treatment can be conducted with reduced environmental load, and such treatment is also capable of improving the coating adhesion to the steel material as well as the corrosion resistance after the coating.

[Patent Literature 1] JP 2004-218074 A

[Patent Literature 2] JP 2004-218070 A

SUMMARY OF INVENTION

Problems to be Solved by the Invention

However, while some improvement in the coating performance may be present in the comparison with the simple zirconium-based chemical conversion treatment, such improvement is still in the stage of laboratory scale evaluation results. Also, these prior art solutions are not necessarily finished techniques in view of the corrosive environment under which the products are actually used, and also, in view of the productivity in the commercial scale production.

For example, when the chemical conversion agent described in the Patent Literature 1 is used with a steel material, the flat surface of the steel material after the coating has good corrosion resistance. However, blisters are often formed at the edge of the steel material after the corrosion resistance test, and peeling of the coating was noted in some cases. In other words, this chemical conversion agent has the problem in the coating adhesion, and this problem can not be ignored when the steel material is actually exposed to the corrosive environment.

In the case of the chemical conversion agent described in the Patent Literature 2, sufficient coating performance can be realized when the chemical conversion is conducted within relatively short period after the preparation of the chemical conversion agent. However, the coating performance tends to decline with increase in the time interval between the preparation of the chemical conversion agent and the chemical conversion. This problem can be avoided by periodically preparing a fresh chemical conversion agent. However, this is a serious problem in view of the productivity.

None of the zirconium-based chemical conversion agents as described above has succeeded in obviating the drawbacks inherent to the zirconium-based chemical conversion agent such as poor throwing power when the steel material is coated by cation electrodeposition coating. The term "throwing power" as used herein means the property that allows the cation electrodeposition coating to be formed even in the interior of a pocket structure.

This invention is an invention which aims at solving the problems as described above. Accordingly, an object of the present invention is to provide a chemical conversion treatment solution which is capable of realizing excellent coating adhesion and corrosion resistance after the coating, as well as improved throwing power in the coating, and in particular, in the electrodeposition coating of a steel material. Another object of the present invention is to provide a method for conducting a chemical conversion treatment.

Means for Solving the Problems

The inventors of the present invention conducted an intensive investigation to solve the problems as described above, and focused on the properties of the zirconium-based chemical conversion agent when a particular amount of a polyethyleneimine having a network structure having the amino group distribution of particular molar ratio is added to the zirconium-based chemical conversion agent. The present invention according to the solution means (1) to (4) was thereby completed.

(1) A chemical conversion treatment solution for a steel material which is an acidic aqueous solution of pH 3 to 5 containing 50 to 500 ppm by weight of zirconium fluoride complex in terms of Zr, 5 to 50 ppm by weight of free fluorine, and 5 to 30% by weight in relation to Zr of polyethyleneimine, wherein the polyethyleneimine has a weight average molecular weight of 600 to 10,000 and the polyethyleneimine has primary amino group, secondary amino group, and tertiary amino group in its molecule and molar ratio of the primary amino group in relation to the total content of the amino group is at least 30% and molar ratio of the tertiary amino group in relation to the total content of the amino group is at least 15%.

(2) A chemical conversion treatment solution according to the above (1) wherein the chemical conversion treatment solution further comprises 30 to 300 ppm by weight of an aluminum fluorine complex in terms of Al and weight ratio of the Al to the Zr is 30 to 300%.

(3) A chemical conversion treatment solution for according to the above (1) or (2) wherein the chemical conversion treatment solution further comprises at least one metal ion selected from the group consisting of Zn, Sn, and Cu.

(4) A method for conducting chemical conversion treatment of a steel material, comprising the steps of maintaining the chemical conversion treatment solution for pretreatment of any one of the above (1) to (3) at 25 to 60° C., immersing the steel material in or spraying the steel material with the chemical conversion treatment solution to thereby conduct the chemical conversion treatment for 1 to 300 seconds, and rinsing the steel material with water.

Advantageous Effects of Invention

The present invention provides a chemical conversion treatment solution for a steel material which has retained the low environmental load and the high corrosion resistance which are the merits of the conventional zirconium-based chemical conversion agents, while improving the poor coating adhesion and the insufficient throwing power in the electrodeposition coating which had been the drawbacks of the conventional zirconium-based chemical conversion agents. The present invention also provides a method of chemical conversion treatment. The steel material which has undergone the chemical conversion by the chemical conversion treatment solution for a steel material of the present invention is expected to exhibit excellent coating adhesion as well as improved corrosion resistance after the coating in actual corrosive environment.

EXPLANATION OF NUMERALS

Figure 1:
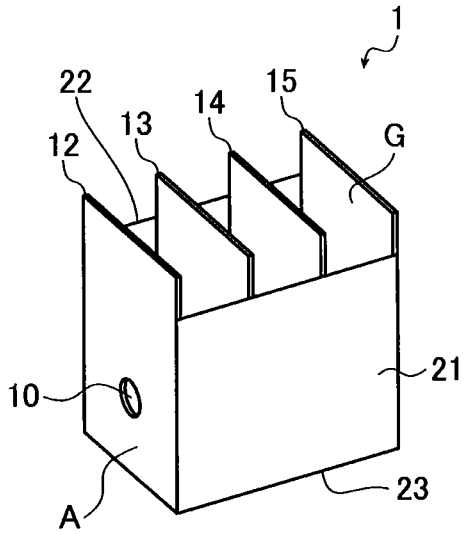
FIG. 1 is a schematic view of the box used in the box test conducted for evaluating throwing power of the coating.

1: box
2: counter electrode
10: hole
12: test plate (steel strip after the coating) (outer side: A)
13, 14: test plate (steel strip after the coating)
15: test plate (steel strip after the coating) (inner side: G)
21, 22: side plate (vinyl chloride resin plate)
23: bottom plate (vinyl chloride resin plate)

BEST MODE FOR CARRYING OUT THE INVENTION

The chemical conversion treatment solution for a steel material of the present invention is a chemical conversion treatment solution for depositing a base coat by chemical conversion whereby the base coat is deposited on the cleaned steel material surface before coating the steel material. More specifically, the chemical conversion treatment solution of the present invention is the one containing Zr, F, and polyethyleneimine, and preferably, the one containing Zr, Al, F, and polyethyleneimine.

(Chemical Conversion Treatment Solution)

The chemical conversion treatment solution of the present invention contains a zirconium fluoride complex. The term "zirconium fluoride complex" used herein means a divalent complex ion having an octahedron structure having fluoride ions hexacoordinated around tetravalent zirconium ion, and more specifically, the "zirconium fluoride complex" is represented by $ZrF_6^{2-}$ in the chemical conversion treatment solution. The Zr in the zirconium fluoride complex is the main component of the chemical conversion coating formed by the chemical conversion treatment of the present invention, and the chemical conversion coating primarily deposits as hydrated zirconium oxide to contribute for the most basic properties, namely, the corrosion resistance and the coating adhesion of a coating for the steel material by its barrier property and chemical stability. The source of the zirconium in the chemical conversion treatment solution is not particularly limited, and exemplary sources include zirconium nitrate, zirconium sulfate, zirconium acetate, and zirconium fluoride, which may be used alone, in combination, or with other sources. However, the chemical conversion treatment solution should contain at least 6 times more molar amount of fluorine than the zirconium since the zirconium fluoride complex should be formed in the chemical conversion treatment solution.

The zirconium fluoride complex used in the chemical conversion treatment solution of the present invention is not particularly limited for its concentration. However, the zirconium fluoride complex is preferably at a concentration of to 500 ppm by weight, more preferably 70 to 300 ppm by weight, and most preferably 100 to 200 ppm by weight in terms of the Zr. When the Zr concentration is too low, corrosion resistance after the coating will be insufficient due to the insufficient coating weight of the chemical conversion coating. On the other hand, excessively high Zr concentration may result in the inferior stability of the chemical conversion treatment solution.

The chemical conversion treatment solution of the present invention contains a polyethyleneimine. The "polyethyleneimine" used in the present invention designates the one having a network structure wherein a primary amino group ($—NH_2$), a secondary amino group (—NH—), and tertiary amino group (═N—) are linked by two hydrocarbons bonded by a single bond ($—CH_2—CH_2—$). The primary amino groups are located at the terminals of the molecule, the secondary amino group contributes for the bonding of the chain structure, and the tertiary amino group forms the branch of the structure. Accordingly, the polyethyleneimine of the present invention has the primary amino group, the secondary amino group, and the tertiary amino group. A typical molecular structure is represented by the following structural formula (3):

[Chemical formula 3]

(3)

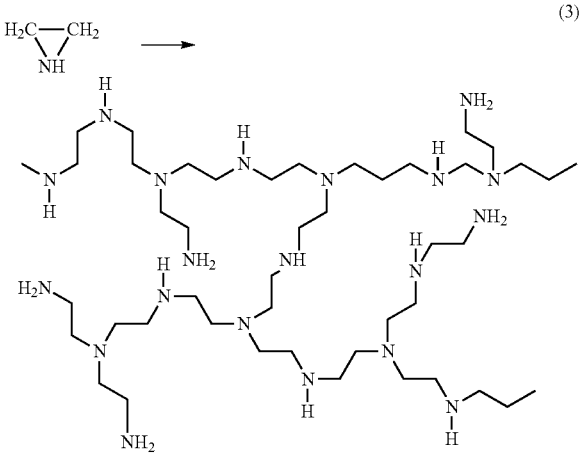

The polyethyleneimines include not only those having a network structure (3) but also those having a straight chain represented by the following structural formula (4). However, the polyethyleneimine of the structural formula (4) is utterly free from the tertiary amino group, and such polyethyleneimine is not expected to have the action of the polyethyleneimine of the structural formula (3) of the present invention. Accordingly, the polyethyleneimine of the present invention is preferably the one not containing the straight chain structural unit represented by the structural formula (4). In the meanwhile, a copolyethyleneimine which includes an ethyleneimine derivative such as propyleneimine as a moiety of the network structure is included in the polyethyleneimine of the present invention as long as the weight average molecular weight and the molar ratio of the primary amino group to the tertiary amino group are not outside the defined ranges.

[Chemical formula 4]

(4)

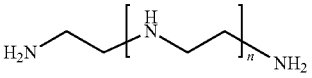

The polyethyleneimine may be produced by ring-opening polymerization of ethyleneimine ($C_2H_5N$). The polyethyleneimine preferably has a weight average molecular weight of 300 to 10000 since the polyethyleneimine does not function as a polymer when the weight average molecular weight is less than 300 while the weight average molecular weight in excess of 10000 results in the difficulty of the incorporation of the polyethyleneimine in the chemical conversion coating, and hence, in the insufficient coating performance. However, since the molecular weight of a macromolecular compound such as the polyethyleneimine is distributed within certain range, purchase of a commercial macromolecular compound having a particular pinpoint molecular weight is difficult in the strict sense, and accordingly, the polyethyleneimine is more preferably the one having a weight average molecular weight of 600 to 5000 in view of such molecular weight distribution.

The polyethyleneimine of the present invention has a primary amino group, a secondary amino group, and a tertiary amino group in one molecule, and it should have a molar ratio of the primary amino group to the total amount of the amino groups of at least 30% and a molar ratio of the tertiary amino group to the total amount of the amino groups of at least 15%. More specifically, the molar ratio of the primary amino group to the total amount of the amino groups is preferably 32 to 50%, and more preferably 35 to 45%, and the molar ratio of the tertiary amino group to the total amount of the amino groups is preferably 18 to 35%, and more preferably 20 to 30%. Corrosion resistance after the coating is insufficient when the molar ratio of the primary amino group is less than 30% while the molar ratio of the tertiary amino group of less than 15% results not only in the failure of realizing the sufficient corrosion resistance after the coating but also in the poor throwing power of the coating. The term "molar ratio" used herein is the ratio of the molar amount of each amino group in relation to the total molar amount of the primary amino group, the secondary amino group, and the tertiary amino group in the polyethyleneimine.

The throwing power is the property that allows, in a structure of a steel material having a pocket structure, the coating composition to reach and form a coating even in the interior of the pocket structure. In this case, the coating in the interior of the pocket structure should have at least the thickness required for imparting an anticorrosive property with the structure since the coating is applied for the purpose of imparting the steel structure with the anticorrosion. Accordingly, the steel material should at least have the throwing power that allows formation of the sufficiently thick coating even in the interior of the pocket structure. In addition, even if the coating formed in the interior of the pocket structure had necessary coating thickness, formation of the coating of excessive thickness in other parts of the plate results in the economically disadvantageous increase in the amount of the coating composition used, and therefore, the thickness of the coating formed in the interior of the pocket structure should be as close as the thickness of the coating formed in other surface.

Cationic electrodeposition coating has distinctly superior throwing power compared to other coating methods. However, the throwing power also depends on the type of the underlying base coating, and the zirconium-based chemical conversion solution is generally inferior in the throwing power compared to the conventional zinc phosphate chemical conversion agent. The polyethyleneimine used in the present invention is a component which is capable of improving the throwing power in the cationic electrodeposition coating, and its action tends to increase with the increase in the molar ratio of the tertiary amino group in the polyethyleneimine as in the case of the factor contributing for the coating adhesion.

Concentration of the polyethyleneimine in the chemical conversion treatment solution should be at a weight ratio of 5 to 30%, preferably 7 to 25%, and more preferably at 10 to 20% in relation to the Zr. When the concentration is too low, the action of the polyethyleneimine for improving the chemical conversion coating will be insufficient and the coating performance of the resulting coating will not be realized. When the concentration is too high, deposition of the Zr which is the major component of the chemical conversion coating will be suppressed, and this also results in the failure of realizing the coating performance. The performance of the chemical conversion coating is not determined solely by the concentration of the polyethyleneimine in the chemical conversion treatment solution, and the desired performance is realized only after adjusting the weight ratio of the polyethyleneimine to the Zr.

The chemical conversion treatment solution of the present invention may further contain an aluminum fluorine complex. The term "aluminum fluorine complex" used herein means a complex ion having fluorine ion coordinated around trivalent aluminum ion, and more specifically, the "aluminum fluorine complex" is represented by $AlF_{(3-n)}^{n+}$ wherein n is a numeric value of −1 to +1 such as $AlF_2^-$, $AlF_3$, or $AlF_4^{2-}$ while n may not be an integer. The aluminum in the aluminum fluorine complex deposits together with the zirconium as trace components in the chemical conversion coating formed by the chemical conversion treatment of the present invention to realize stress relaxation of the chemical conversion coating mainly comprising the hydrated zirconium oxide so that the stress of the chemical conversion coating primarily caused by the heat of the baking is relaxed, and to thereby further improve the adhesion between the chemical conversion coating and the underlying metal material, and hence, the coating performance.

Source of the aluminum in the chemical conversion treatment solution is not particularly limited, and exemplary sources include aluminum nitrate, aluminum sulfate, aluminum hydroxide, and aluminum fluoride, which may be used alone, in combination, or with other sources. The aluminum may also be supplied in the form of metal aluminum, and when an aluminum material is subjected to the chemical conversion treatment with the steel material, aluminum supply from other sources may be stopped or reduced. However, the chemical conversion treatment solution should contain 2 to 4 times more molar amount of fluorine than the aluminum since the aluminum fluoride complex should be formed in the chemical conversion treatment solution.

Concentration of the aluminum in the chemical conversion treatment solution of the present invention is preferably 30 to 300 ppm by weight, and more preferably 50 to 200 ppm by weight, and weight ratio of the aluminum to the zirconium is preferably to 300%, more preferably 40 to 250%, and still more preferably 50 to 200%.

The chemical conversion treatment solution of the present invention contains fluorine. The source of the fluorine in the chemical conversion treatment solution is not particularly limited, and exemplary sources include zirconium fluoride, aluminum fluoride, hydrofluoric acid, and ammonium fluoride, which may be used alone, in combination, or with other sources.

The fluorine in the chemical conversion treatment solution of the present invention finally forms a complex with the Zr and the Al when the fluorine is supplied from such source. In the zirconium fluoride complex, 6 moles of fluorine is coordinated to 1 mole of the zirconium, and in the aluminum fluoride complex, 2 to 4 moles of fluorine is coordinated to 1 mole of the aluminium. The coordination number of the fluorine to the aluminum can not be particularly defined since the coordination number varies by the pH of the chemical conversion treatment solution.

The chemical conversion treatment solution of the present invention contains a fluoride ion which does not form the complex with either Zr or Al. Such fluoride ion is referred to as the free fluorine. Concentration of the free fluorine is preferably 5 to 50 ppm by weight, more preferably 6 to 30 ppm by weight, and most preferably 7 to 20 ppm by weight. When the concentration is too low, etching of the steel material will be insufficient and the chemical conversion coating will have insufficient coating weight. This results in the reduced coating adhesion, and also, in the loss of the stability of the chemical conversion treatment solution since the fluorine required for the complexing of the Zr and Al will be insufficient. On the contrary, excessively high concentration results in the excessive etching, which in turn leads to insufficient coating weight of the chemical conversion coating, and hence, in the poor corrosion resistance after the coating. The concentration of the free fluorine may be measured by using a fluorine ion electrode.

The chemical conversion treatment solution of the present invention should have a pH of 3.0 to 5.0. The pH is relevant with the etching ability, and the corrosion resistance after the coating also depends on the pH. The pH is preferably in the range of 3.5 to 4.5. When the pH is too low, etching ability for the steel material will be too high, leading to excessive etching which results in the decrease in the coating weight of the chemical conversion coating as well as loss of the consistency of the chemical conversion coating, namely, in the insufficient corrosion resistance after the coating. On the contrary, excessively high pH results in the insufficient etching ability, which also invites decrease in the coating weight of the chemical conversion coating, and in turn, reduced coating adhesion. Such excessively high pH is also unfavorable in view of the loss of the stability of the chemical conversion treatment solution.

The reagent used for adjusting the pH of the chemical conversion treatment solution, when pH adjustment is necessary, is not particularly limited. Exemplary reagents include acids such as sulfuric acid, nitric acid, hydrofluoric acid, and organic acids and alkali such as lithium hydroxide, potassium hydroxide, sodium hydroxide, sodium carbonate, ammonia solution, ammonium carbonate, and triethanolamine.

Preferably, the chemical conversion treatment solution of the present invention further comprises at least one metal ion selected from Zn, Sn, and Cu. Such metal ion is effective for further improving the throwing power, and in particular, when the cationic electrodeposition coating is employed.

The source of the metal ion is not particularly limited. However, exemplary sources include metal salts such as nitrate, sulfate, and fluoride. The metal ion may be used, in the case of Zn, preferably at 100 to 2000 ppm by weight and more preferably at 500 to 1500 ppm by weight, in the case of Sn, preferably at 10 to 200 ppm by weight and more preferably at 15 to 100 ppm by weight, and in the case of Cu, preferably at 5 to 100 ppm by weight and more preferably at 10 to 50 ppm by weight. When two or more such metal ions are used in combination, the preferable range is as described above regardless of the ratio with the concentration of other metal ions.

The chemical conversion treatment solution of the present invention may also contain a surfactant. When a surfactant is incorporated, excellent chemical conversion coating will deposit on the steel material even if the degreasing and the cleaning are omitted. Exemplary surfactants include nonionic, anionic, cationic, and amphoteric surfactants, and the most preferred are the nonionic surfactants. Any suitable surfactant may be selected depending on the type and amount of the oil component present on the steel material. Concentration of the surfactant is typically around 100 to 2000 ppm by weight.

The chemical conversion treatment solution of the present invention is used for deposition of a chemical conversion coating primarily comprising hydrated zirconium oxide on the surface of a steel material by chemical conversion. Accordingly, presence of the compound which inhibits etching reaction of the surface and the compound which inhibits deposition of the chemical conversion coating by excessively stabilizing the zirconium in the chemical conversion treatment solution is undesirable. Examples of the compound which inhibits etching reaction of the steel material surface include anhydrous chromic acid and potassium permanganate. Examples of the compound which inhibits deposition of the chemical conversion coating include EDTA, citric acid, and tartaric acid which exhibit low stability when chelated with zirconium.

On the other hand, presence a metal ion such as Ca, Mg, Fe, Mn, or Ni; an inorganic acid such as phosphoric acid or condensed phosphoric acid; silica, silane coupling agent, or an amino group-containing resin other than the polyethyleneimine in the chemical conversion treatment solution of the present invention is allowable. Such allowable components include inevitably included components such as components in the degreasing agent used in the previous step, components in the water used, and components included in the etching of the steel material.

(Steel Material)

The material which is subject to the chemical conversion by the chemical conversion treatment solution of the present invention is a steel material. The "steel material" is a generic term including materials comprising iron or iron alloy. Exemplary such steel materials include steel strips such as cold rolled steel strip, hot rolled steel strip, and zinc plated steel strip, steel pipes, and castings. The steel materials also include combined structures produced by shaping, bonding and/or assembling one or more of such materials. In addition, while the chemical conversion treatment solution and the chemical conversion treatment method of the present invention are particularly effective when used for a steel material, they are also effective to some extent when used for a metal material other than the steel material. Accordingly, the combined structures may contain the part comprising a material other than the steel material such as magnesium or aluminum alloy plate.

(Pretreatment)

The steel material is preferably cleansed by degreasing before the chemical conversion treatment of the present invention. The method used for the degreasing is not particularly limited, and any method known in the art may be used for the degreasing.

(Chemical Conversion Method)

The method used for conducing the chemical conversion treatment of the steel material according to the present invention is not particularly limited as long as it uses the chemical conversion treatment solution of the present invention. However, the preferred are spraying and dipping, and the most preferred is the dipping in view of the relative easiness of depositing the chemical conversion coating on the surface of the steel material.

The chemical conversion treatment of the present invention is preferably conducted at a temperature in the range of 25 to 60° C. When the temperature is too low, Zr coating weight of the chemical conversion coating will be insufficient. Use of an excessively high temperature is economically disadvantageous.

The time used for conducting the chemical conversion treatment of the present invention is not particularly limited. However, the chemical conversion treatment is preferably conducted for 1 to 300 seconds since a favorable coating weight of the chemical conversion coating is readily realized when the time is within such range.

(Post Treatment)

After the chemical conversion treatment of the present invention, the steel material is preferably rinsed with water. The method used for the rinsing with water is not particularly limited to any particular method, and exemplary methods include immersion in and spraying of the water. The chemical conversion treatment solution of the present invention contains various metal salts, and the metal salt remaining on the steel surface will be the cause of the insufficient adhesion of the subsequent coating. The rinsing with water may also be effected in two or more steps to thereby improve the rinsing efficiency. The quality of the water used for the rinsing is not particularly limited since the desirable water quality is determined by the type of the coating applied in the subsequent step. However, concentration of the remaining metal salt is preferably around 1% by weight, and more preferably, up to 0.1% by weight of the chemical conversion treatment solution.

(Chemical Conversion Coating)

The surface of the steel material treated by chemical conversion using the chemical conversion treatment solution of the present invention has a chemical conversion coating adhered thereto. The chemical conversion coating mainly comprises amorphous hydrated zirconium oxide, and it also contains a certain amount of polyethyleneimine.

Zr coating weight of the chemical conversion coating is preferably 10 to 100 $mg/m^2$, and more preferably 20 to 60 $mg/m^2$. Excessively low Zr coating weight results in the insufficient corrosion resistance after the coating, while excessively high Zr coating weight results in the poor coating adhesion. The Zr coating weight may generally be quantitatively measured by X-ray fluorescent spectroscopy.

Next, the background and the postulation how the inventors of the present invention found that the chemical conversion coating obtained by using the chemical conversion treatment solution of the present invention provides the steel material with the excellent coating adhesion and corrosion resistance after the coating and completed the present invention on the bases of such finding are described.

It has been known in the art that inclusion of the resin containing a primary amino group improves corrosion resistance and other coating performance in the zirconium-based chemical conversion coating. However, the resin containing a primary amino group does not improve coating adhesion or throwing power in the electrodeposition coating. With regard to such resin containing the primary amino group, the inventors of the present invention found that the coating adhesion and the throwing power in the electrodeposition coating can be improved if a tertiary amino group is introduced in such resin containing the primary amino group. In addition, since the inventors also found that these three properties vary depending on the molar ratio of the primary amino group to the tertiary amino group of the primary, secondary, and tertiary amino groups in the resin, the molar ratio of the primary amino group to the tertiary amino group was limited to the certain preferable range to simultaneously satisfy these three properties. The present invention was thereby completed.

For example, silane coupling agent in the zirconium-based chemical conversion agent plays the expected effect if the adsorption onto the surface of the steel material and the condensation reaction proceed in ideal manner. However, due to the reaction mechanism of the silane-coupling agent, condensation of the silanol group proceeds in an aqueous solution until the silane-coupling agent finally becomes insoluble, and the adsorption onto the steel material surface is no longer expectable. In other words, the effect of the silane coupling agent reduces with lapse of time.

On the other hand, various amino group-containing resins used in the zirconium-based chemical conversion agent enjoy good long term stability and realizes corrosion resistance after the coating of the chemical conversion coating. However, coating adhesion was not necessarily sufficient. The inventors of the present invention made various investigations by focusing on the amino group-containing resin having the effect of improving the corrosion resistance after the coating.

The amino groups of the polyethyleneimine used in the present invention include primary amino group, secondary amino group, and tertiary amino group. The amino group-containing resin which has been used for incorporation in the zirconium-based chemical conversion agent was the resin mainly containing the primary amino group, and in the case of such resin, the corrosion resistance after the coating of the chemical conversion coating could be improved by increasing the molar ratio of the primary amino group while improvement of the coating adhesion was insufficient. In contrast, the inventors found that the coating adhesion can be dramatically improved by increasing the molar ratio of the tertiary amino group in the amino group-containing resin while such increase has small effect on the improvement of the corrosion resistance after the coating. In the meanwhile, increase in the molar ratio of the secondary amino group has neither the effect of improving the corrosion resistance after the coating of the chemical conversion coating nor the effect of improving the coating adhesion. In other words, the inventors found that the corrosion resistance after the coating and the coating adhesion are simultaneously fulfilled only when the primary amino group and the tertiary amino group are simultaneously present at a certain molar ratio in the molecule of the amino group-containing resin, and the present invention has been completed on the bases of such finding.

Of various amino group-containing resins, a polyethyleneimine having a three-dimensional structure, namely, a network structure has highest molar ratio of the amino group per molecule, and the polyethyleneimine also allows adjustment of the molar ratio of the primary amino group to the tertiary amino group to some degree. Accordingly, the polyethyleneimine which can simultaneously contain the primary amino group and the tertiary amino group at a considerable molar ratio is highly suitable for the amino group-containing resin for the zirconium-based chemical conversion agent. The inventors found that coating performance can be further improved by limiting the content of both the primary amino group and the tertiary amino group to the most preferable range, and the present invention has been completed on the gases of such finding.

(Coating)

Next, the steel material which has been subjected to the chemical conversion treatment by the chemical conversion treatment solution of the present invention and rinsed with water is coated. The coating applied is not limited to any particular type, and exemplary coatings include those known in the art such as solvent coating, water-based coating, electrodeposition coating, and powder coating. In the case of solvent coating or powder coating, the steel material is preferably drip-dried since water present on the surface of the steel material is undesirable for the coating. The drying step is not particularly required in other cases.

EXAMPLES

Next, the present invention is described in further detail by referring to Examples and Comparative Examples.

Nature of the amino group-containing resin such as polyethyleneimine is shown in Table 1. Composition and nature of the chemical conversion treatment solution, conditions of the chemical conversion treatment, properties of the chemical conversion coating, and coating performance are shown in Table 2.

(Steel Material)

Cold rolled steel strip [SPCC (JIS 3141) (70×150×0.8 mm) manufactured by Paltek Corporation] or alloyed hot-dip galvanized steel strip [SGCC F06MO (JIS G3302) (70×150×0.8 mm) manufactured by Paltek Corporation] was used for the steel material.

(Polyethyleneimine)

The polyethyleneimines used were EPOMIN SP-006 (A1), EPOMIN SP-200 (B1) and EPOMIN SP-1000 (B2) manufactured by Nippon Shokubai Co., Ltd.; and Lupasol FG, G20, G35, and G100 (A2 to A5) manufactured by BASF. The polyallylamine used was PAA01 (B4) manufactured by Nitto Boseki Co., Ltd.

The weight average molecular weight was measured by GPC. The measurement was carried out by using maltotriose, maltoheptaose, and pullulan of various molecular weights for the standard substance, and the molecular weight was determined in terms of pullulan using a GPC apparatus (HPC-8200 manufactured by Toso Co., Ltd.) by measuring RI (difference in the refractive index). The molar ratio of the primary amino group to the tertiary amino group in the molecule was measured by NMR at a temperature of at least 90° C. More specifically, the molar ratio was measured by using the principle that the carbon atom adjacent to the primary amino group, the carbon atom adjacent to the secondary amino group, and the carbon atom adjacent to the tertiary amino group respectively show different chemical shift, and the molar ratio of the amino groups was calculated from the results of $^{13}C$ NMR peak analysis. The calculation was conducted by using the following equation:

$$\text{the primary amino group:the secondary amino group:the tertiary amino group}=[I_{39.4}+I_{41.2}]:[I_{47.2}+I_{49.0}+I_{52.0}]/2]:[I_{52.8}+I_{54.6}+I_{57.8}]/3$$

wherein In stands for the peak value of the chemical shift at n ppm.

(Pretreatment)

A cold rolled steel strip or an alloyed hot-dip galvanized steel strip was sprayed for 120 seconds on its surface with a degreasing agent [FC-E2001 manufactured by Nihon Parkerizing Co., Ltd] which has been heated to 40° for the degreasing of the steel strip to thereby remove the anticorrosive oil. Next, the cold rolled steel strip was rinsed by spraying water to its surface for the removal of the degreasing agent.

(Chemical Conversion Treatment)

The cold rolled steel strip or the alloyed hot-dip galvanized steel strip which has been rinsed with water as described above is then immersed in the chemical conversion treatment solution having the composition as described below at 40° C. for 90 seconds to thereby allow deposition and adhesion of the chemical conversion coating.

(Posttreatment)

The cold rolled steel strip or the alloyed hot-dip galvanized steel strip having the chemical conversion coating deposited and adhered is then rinsed with water by spraying deionized water for 30 seconds.

(Electrodeposition Coating)

The cold rolled steel strip or the alloyed hot-dip galvanized steel strip which has undergone the chemical conversion was then subjected to cathode electrolysis at a constant voltage for 180 seconds by using an electrodeposition coating composition [manufactured by Kansai Paint Co., Ltd.: GT-10HT] and using a stainless steel plate (SUS304) for the anode to thereby deposit the coating on the entire surface of the steel strip. The steel strip was then rinsed with water and baked at 170° C. for 20 minutes to thereby form the coating. The coating was adjusted to a thickness of 20 μm by controlling the voltage. The cold rolled steel strip or the alloyed hot-dip galvanized steel strip which has undergone the chemical conversion and the spray rinsing was not dried before the electrodeposition coating.

(Solvent Coating)

The cold rolled steel strip or the alloyed hot-dip galvanized steel strip which has undergone the chemical conversion was then spray-coated using a solvent coating composition [Amilac TP-37 manufactured by Kansai Paint Co., Ltd.] to a thickness (thickness after drying) of 30 μm and baked at 140° C. for 20 minutes. The cold rolled steel strip or the alloyed hot-dip galvanized steel strip which has undergone the chemical conversion and the spray rinsing was dried at 100° C. for 10 minutes before the solvent coating.

(Free Fluorine Concentration of the Chemical Conversion Treatment Solution)

Two fluorine standard solutions containing 50% by volume of TISAB each having the fluorine concentration adjusted to 5 ppm and 50 ppm by adding NaF were prepared. Fluorine ion meter was calibrated by using these fluorine standard solutions, and the chemical conversion treatment solution was directly measured for the free fluorine concentration.

(Zr Coating Weight of the Chemical Conversion Coating)

Zr coating weight of the chemical conversion coating was quantitatively measured by using an X-ray fluorescent (XRF) spectrometer [ZSX Primus II manufactured by RIGAKU]. The results are shown in Table 1.

(Evaluation of Corrosion Resistance After the Coating)

Salt spray test (JIS-Z2371-2000) was conducted after forming cross cuts on the cold rolled steel strip after the coating or the alloyed hot-dip galvanized steel strip with a cutter knife, and single side blistering width at the cross cut was measured after 1000 hours. The results were evaluated according to the following criteria:

A: less than 2 mm

B: at least 2 mm and less than 4 mm

C: at least 4 mm and less than 6 mm

D: at least 6 mm (Evaluation of Coating Adhesion)

After the coating, the cold rolled steel strip or the alloyed hot-dip galvanized steel strip was immersed in boiling water for 1 hour, and cross cuts were formed with a cutter knife. Central part of the cross cut was drawn to a depth of 4 mm with an Erichsen tester. An adhesive tape was then adhered and peeled to measure the area percentage of the peeling. The results were evaluated according to the following criteria:

A: less than 5%

B: at least 5% and less than 10%

C: at least 10% and less than 30%

D: at least 30%

(Throwing Power of the Electrodeposition Coating)

Four metal plates 12 to 15 of the same type were provided, and a hole 10 having a diameter of 8 mm was formed in three metal plates 12 to 14 of the 4 metal plates. The hole 10 was formed at the center in vertical direction, and in the axial direction, at a position 50 mm from one short side of the rectangle (so that minimum distance between the center of the hole and one short side of the rectangle is 50 mm) and at 100 mm from the other short side of the rectangle. Next, a four plate box as shown in FIG. 1 was assembled by using these four steel plates 12 to 15 and three vinyl chloride resin plates 21 to 23. In FIG. 1, the four steel plates 12 to 15 are arranged parallel to each other so that the distance between the adjacent plates is 20 mm for all plates, and while the steel plates 12 to 14 have the hole 10, the steel plate 15 has no hole. The side of the steel plate 12 not facing the steel plate 13 was designated surface A, while the surface of the steel plate 15 facing the steel strip 14 was designated surface G.

Next as shown in FIG. 1, two vinyl chloride resin plates 21 and 22 were respectively adhered by an adhesive tape to the long sides of four metal plates so that each vinyl chloride plate was in contact with the long side of all steel plates. A vinyl chloride resin plate 23 was also adhered by an adhesive tape so that the plate was in contact with the short side of all four metal plates, and to thereby form the four plate box 1.

Figure 2:
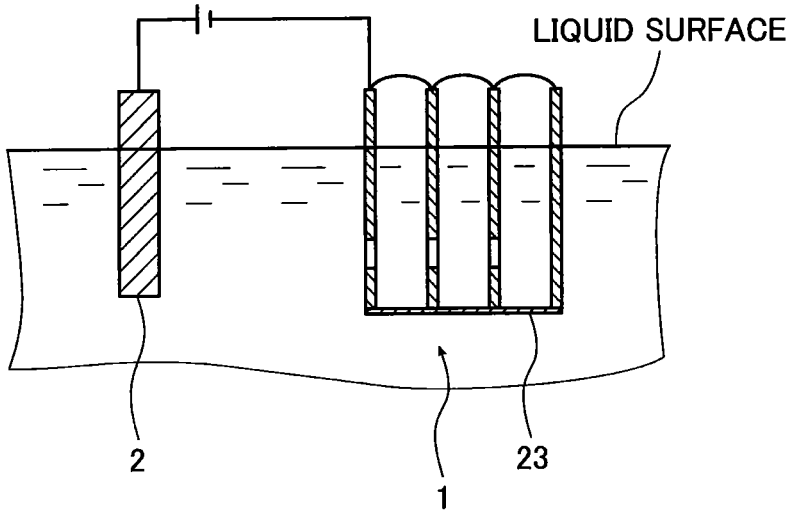
FIG. 2 is a cross sectional view for general description of the box test conducted for evaluating throwing power of the coating.
Figure 3:
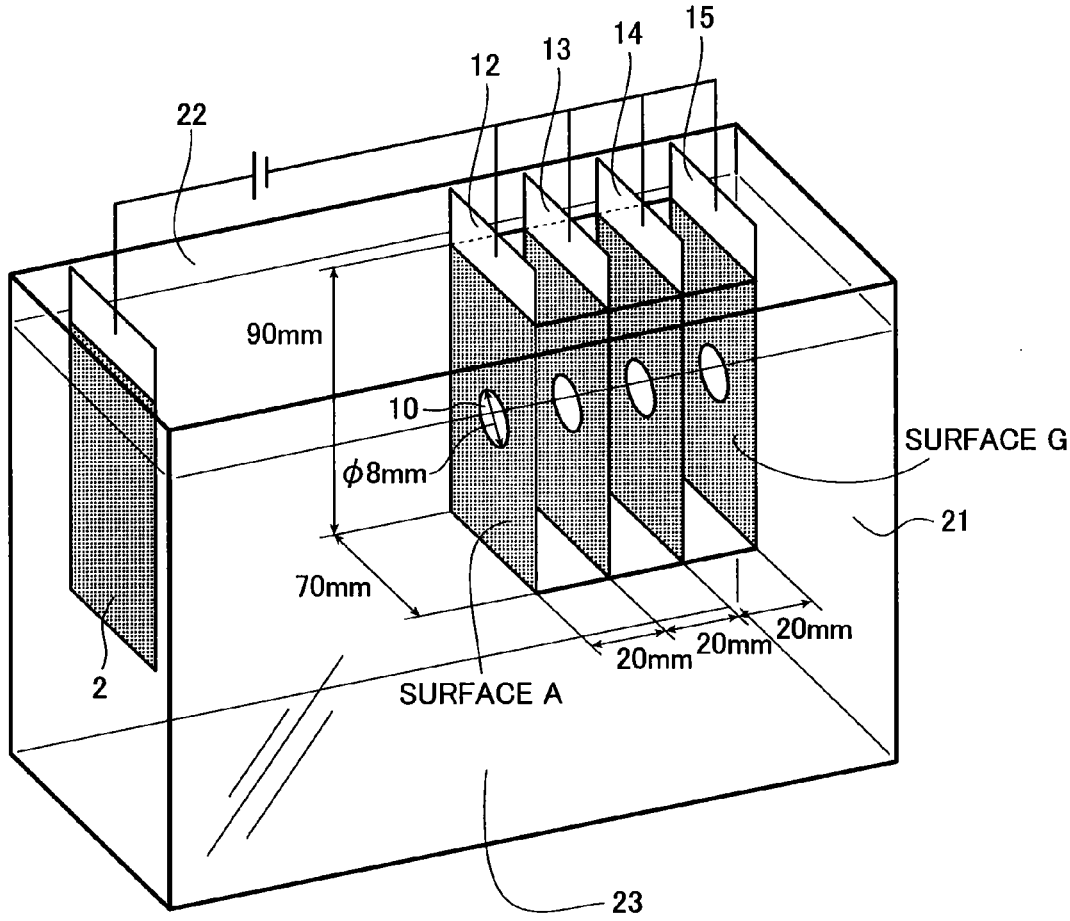
FIG. 3 is a perspective view for general description of the box test conducted for evaluating throwing power of the coating.

Next, the four plate box 1 and the counter electrode 2 were arranged as shown in FIGS. 2 and 3. More specifically, the four-plate box was arranged so that the metal plate 12 having the hole 10 formed therein was on the side near the counter electrode 2. Wiring was conducted to short-circuit all of the four metal plates 12 to 15. FIG. 2 is a cross sectional view at the center of the short side of the metal plate, and FIG. 3 is a perspective view. It is to be noted that the vinyl chloride resin plates 21 and 22 are omitted in FIG. 2. A stainless steel plate (SUS304) of 70×150×0.55 mm having one surface (the surface not facing the four plate box) insulated with an insulating tape was used for the counter electrode 2. Electrodeposition paint ("GT-10HT" manufactured by Kansai Paint Co., Ltd.) was filled until the metal plates 12 to 15 and the counter electrode were dipped to a depth of 90 mm from the liquid surface. The paint was maintained at a temperature of 28° C., and the electrodeposition was conducted while stirring the paint with a stirrer.

Under the conditions as described above, a coating was deposited on the surface of the metal plates 12 to 15 of the four plate box by cathode electrolysis using the counter electrode for the anode. The cathode electrolysis was conducted at a predetermined voltage for 180 seconds by using a rectifier. The voltage was adjusted so that the coating on surface A of the four-plate box would have a thickness of 20 μm. After the electrolysis, each of the metal plates 12 to 15 was rinsed with water, and baked at 170° C. for 20 minutes to form the coating.

Thickness of the coating formed on surface G was measured by an electromagnetic coating thickness meter. The thickness was evaluated according to the following criteria. Average of the coating thickness measured at 10 randomly selected locations was used for the thickness of the coating on surface G.

A: at least 10 μm,

B: at least 8 μm and less than 10 μm,

C: at least 6 μm and less than 8 μm, and

D: less than 6 μm.

Next, the method used for preparing the chemical conversion treatment solution used in the Examples and the Comparative Examples is described. The polyethyleneimines A1 to A5 and B1 to B3 and the polyallylamine B4 had the nature as shown in Table 1.

Example 1

40% aqueous solution of hexafluorozirconic acid (60 ppm by weight in terms of Zr), aluminum nitrate (40 ppm by weight in terms of Al) (Al/Zr=67%), polyethyleneimine A1 (at a weight ratio of 28% in relation to Zr (17 ppm by weight)), and 55% hydrofluoric acid (at an amount such that free fluorine concentration is 6 ppm by weight) were added, and pH was adjusted to 4.8 with 3% ammonia solution to thereby prepare a chemical conversion treatment solution. The solution was heated to 45° C. The polyethyleneimine A1 had a primary amino group ratio of 35% by mole, a secondary amino group ratio of 35% by mole, a tertiary amino group ratio of 30% by mole, and a weight average molecular weight of 600. The term "amino group ratio" used herein is the molar ratio of the amino group.

This chemical conversion treatment solution was used for chemical conversion treatment of the cold rolled steel plate and the alloyed hot-dip galvanized steel plate to thereby deposit a chemical conversion coating.

Example 2

40% aqueous solution of hexafluorozirconic acid (100 ppm by weight in terms of Zr), aluminum nitrate (50 ppm by weight in terms of Al) (Al/Zr=50%), polyethyleneimine A2 (at a weight ratio of 10% in relation to Zr (10 ppm by weight)), and 55% hydrofluoric acid (at an amount such that free fluorine concentration is 10 ppm by weight) were added, and pH was adjusted to 4.0 with 3% ammonia solution to thereby prepare a chemical conversion treatment solution. The solution was heated to 30° C. The polyethyleneimine A2 had a primary amino group ratio of 44% by mole, a secondary amino group ratio of 38% by mole, a tertiary amino group ratio of 18% by mole, and a weight average molecular weight of 800.

This chemical conversion treatment solution was used for chemical conversion treatment of the cold rolled steel plate to thereby deposit a chemical conversion coating.

Example 3

40% aqueous solution of hexafluorozirconic acid (100 ppm by weight in terms of Zr), aluminum nitrate (50 ppm by weight in terms of Al) (Al/Zr=50%), copper nitrate (20 ppm by weight in terms of Cu), and polyethyleneimine A2 (at a weight ratio of 10% in relation to Zr (10 ppm by weight)), and 55% hydrofluoric acid (at an amount such that free fluorine concentration is 10 ppm by weight) were added, and pH was adjusted to 4.0 with 3% ammonia solution to thereby prepare a chemical conversion treatment solution. The solution was heated to 30° C. The polyethyleneimine A2 had a primary amino group ratio of 44% by mole, a secondary amino group ratio of 38% by mole, a tertiary amino group ratio of 18% by mole, and a weight average molecular weight of 800.

This chemical conversion treatment solution was used for chemical conversion treatment of the cold rolled steel plate to thereby deposit a chemical conversion coating.

Example 4

40% aqueous solution of hexafluorozirconic acid (200 ppm by weight in terms of Zr), aluminum nitrate (100 ppm by weight in terms of Al) (Al/Zr=50%), polyethyleneimine A3 (at a weight ratio of 6% in relation to Zr (12 ppm by weight)), 55% hydrofluoric acid (at an amount such that free fluorine concentration is 20 ppm by weight) were added, and pH was adjusted to 4.0 with 3% ammonia solution to thereby prepare a chemical conversion treatment solution. The solution was heated to 40° C. The polyethyleneimine A3 had a primary amino group ratio of 39% by mole, a secondary amino group ratio of 36% by mole, a tertiary amino group ratio of 25% by mole, and a weight average molecular weight of 1300.

This chemical conversion treatment solution was used for chemical conversion treatment of the cold rolled steel plate to thereby deposit a chemical conversion coating.

Example 5

Zirconium ammonium fluoride (400 ppm by weight in terms of Zr), aluminum fluoride (130 ppm by weight in terms of Al) (Al/Zr=33%), polyethyleneimine A4 (at a weight ratio of 20% in relation to Zr (80 ppm by weight)), and ammonium hydrogen fluoride (at an amount such that free fluorine concentration is 45 ppm by weight) were added, and pH was adjusted to 4.0 with ammonium bicarbonate to thereby prepare a chemical conversion treatment solution. The solution was heated to 40° C. The polyethyleneimine A4 had a primary amino group ratio of 38% by mole, a secondary amino group ratio of 36% by mole, a tertiary amino group ratio of 26% by mole, and a weight average molecular weight of 2000.

This chemical conversion treatment solution was used for chemical conversion treatment of the cold rolled steel plate to thereby deposit a chemical conversion coating.

Example 6

40% aqueous solution of hexafluorozirconic acid (100 ppm by weight in terms of Zr), aluminum nitrate (280 ppm by weight in terms of Al) (Al/Zr=280%), and polyethyleneimine A5 (at a weight ratio of 30% in relation to Zr (30 ppm by weight)), 55% hydrofluoric acid (at an amount such that free fluorine concentration is 20 ppm by weight) were added, and pH was adjusted to 4.0 with 3% ammonia solution to thereby prepare a chemical conversion treatment solution. The solution was heated to 40° C. The polyethyleneimine A5 had a primary amino group ratio of 36% by mole, a secondary amino group ratio of 37% by mole, a tertiary amino group ratio of 27% by mole, and a weight average molecular weight of 5000.

This chemical conversion treatment solution was used for chemical conversion treatment of the cold rolled steel plate and the alloyed hot-dip galvanized steel plate to thereby deposit a chemical conversion coating.

Example 7

40% aqueous solution of hexafluorozirconic acid (200 ppm by weight in terms of Zr), aluminum nitrate (150 ppm by weight in terms of Al) (Al/Zr=75%), polyethyleneimine A4 (at a weight ratio of 8% in relation to Zr (15 ppm by weight)), and 55% hydrofluoric acid (at an amount such that free fluorine concentration is 20 ppm by weight) were added, and pH was adjusted to 3.2 with 3% ammonia solution to thereby prepare a chemical conversion treatment solution. The solution was heated to 40° C.

This chemical conversion treatment solution was used for chemical conversion treatment of the cold rolled steel plate to thereby deposit a chemical conversion coating.

Example 8

40% aqueous solution of hexafluorozirconic acid (200 ppm by weight in terms of Zr), aluminum nitrate (150 ppm by weight in terms of Al) (Al/Zr=75%), zinc nitrate (1000 ppm by weight in terms of Zn), polyethyleneimine A4 (at a weight ratio of 8% in relation to Zr (15 ppm by weight)), and 55% hydrofluoric acid (at an amount such that free fluorine concentration is 20 ppm by weight) were added, and pH was adjusted to 3.2 with 3% ammonia solution to thereby prepare a chemical conversion treatment solution. The solution was heated to 40° C.

This chemical conversion treatment solution was used for chemical conversion treatment of the cold rolled steel plate to thereby deposit a chemical conversion coating.

Example 9

40% aqueous solution of hexafluorozirconic acid (300 ppm by weight in terms of Zr), polyethyleneimine A3 (at a weight ratio of 5% in relation to Zr (15 ppm by weight)), and 55% hydrofluoric acid (at an amount such that free fluorine concentration is 30 ppm by weight) were added, and pH was adjusted to 4.0 with 3% ammonia solution to thereby prepare a chemical conversion treatment solution. The solution was heated to 40° C.

This chemical conversion treatment solution was used for chemical conversion treatment of the cold rolled steel plate to thereby deposit a chemical conversion coating.

Example 10

40% aqueous solution of hexafluorozirconic acid (300 ppm by weight in terms of Zr), tin fluoride (20 ppm by weight in terms of Sn), polyethyleneimine A3 (at a weight ratio of 5% in relation to Zr (15 ppm by weight)), and 55% hydrofluoric acid (at an amount such that free fluorine concentration is 30 ppm by weight) were added, and pH was adjusted to 4.0 with 3% ammonia solution to thereby prepare a chemical conversion treatment solution. The solution was heated to 40° C.

This chemical conversion treatment solution was used for chemical conversion treatment of the cold rolled steel plate to thereby deposit a chemical conversion coating.

Comparative Example 1

40% aqueous solution of hexafluorozirconic acid (40 ppm by weight in terms of Zr), aluminum nitrate (130 ppm by weight in terms of Al) (Al/Zr=325%), and polyethyleneimine B2 (at a weight ratio of 33% in relation to Zr (33 ppm by weight)), 55% hydrofluoric acid (at an amount such that free fluorine concentration is 10 ppm by weight) were added, and pH was adjusted to 5.2 with 3% ammonia solution to thereby prepare a chemical conversion treatment solution. The solution was heated to 40° C. The polyethyleneimine B2 had a primary amino group ratio of 25% by mole, a secondary amino group ratio of 50% by mole, a tertiary amino group ratio of 25% by mole, and a weight average molecular weight of 75000.

This chemical conversion treatment solution was used for chemical conversion treatment of the cold rolled steel plate and the alloyed hot-dip galvanized steel plate to thereby deposit a chemical conversion coating.

Comparative Example 2

40% aqueous solution of hexafluorozirconic acid (200 ppm by weight in terms of Zr), aluminum nitrate (100 ppm by weight in terms of Al) (Al/Zr=50%), and polyethyleneimine B3 (at a weight ratio of 13% in relation to Zr (25 ppm by weight)), 55% hydrofluoric acid (at an amount such that free fluorine concentration is 20 ppm by weight) were added, and pH was adjusted to 4.0 with 3% ammonia solution to thereby prepare a chemical conversion treatment solution. The solution was heated to 40° C. The polyethyleneimine B3 was a straight chain polyethyleneimine(pentaethylenehexamine) having a primary amino group ratio of 33% by mole, a secondary amino group ratio of 67% by mole, a tertiary amino group ratio of 0% by mole, and a molecular weight of 204.

This chemical conversion treatment solution was used for chemical conversion treatment of the cold rolled steel plate to thereby deposit a chemical conversion coating.

Comparative Example 3

40% aqueous solution of hexafluorozirconic acid (200 ppm by weight in terms of Zr), aluminum nitrate (100 ppm by weight in terms of Al) (Al/Zr=50%), and polyethyleneimine B1 (at a weight ratio of 25% in relation to Zr (50 ppm by weight)), 55% hydrofluoric acid (at an amount such that free fluorine concentration is 55 ppm by weight) were added, and pH was adjusted to 2.8 with 3% ammonia solution to thereby prepare a chemical conversion treatment solution. The solution was heated to 40° C. The polyethyleneimine B1 had a primary amino group ratio of 35% by mole, a secondary amino group ratio of 35% by mole, a tertiary amino group ratio of 30% by mole, and a weight average molecular weight of 20000.

This chemical conversion treatment solution was used for chemical conversion treatment of the cold rolled steel plate to thereby deposit a chemical conversion coating.

Comparative Example 4

40% aqueous solution of hexafluorozirconic acid (100 ppm by weight in terms of Zr) and polyallylamine B4 (at a weight ratio of 500% in relation to Zr (500 ppm by weight)), were added, and pH was adjusted to 4.0 with sodium hydroxide to thereby prepare a chemical conversion treatment solution. The solution was heated to 40° C. The polyallylamine B4 had a primary amino group ratio of 100% by mole and a weight average molecular weight of 1000. This Comparative Example 4 is an attempt to replicate the chemical conversion treatment solution of Example 2 in the Patent Literature 1.

This chemical conversion treatment solution was used for chemical conversion treatment of the cold rolled steel plate to thereby deposit a chemical conversion coating.

The composition of the chemical conversion treatment solution (Zr concentration, Al concentration, Zr/Al, free fluorine ion concentration, concentration of the added metal ion, pH, molar ratio of the amino group, weight average molecular weight, concentration, concentration in relation to Zr), type of the steel plate, Zn coating weight of the chemical conversion coating, and properties of the electrodeposition coating (corrosion resistance after the coating, coating adhesion, and throwing power) and properties of the solvent coating (corrosion resistance after the coating and coating adhesion) in Examples 1 to 10 and Comparative Examples 1 to 4 are shown together in Table 2.

TABLE 1

| Code | Resin name | Supplier | Product name | Product No. | Primary amino roup | Secondary amino group | Tertiary amino group | Molecular weight | Note |
|---|---|---|---|---|---|---|---|---|---|
| A1 | Polyethyleneimine | Nippon Shokubai | EPOMIN | SP-006 | 35% | 35% | 30% | 600 | The polyethyleneimine of claim 1 |
| A2 | Polyethyleneimine | BASF | Lupasol | FG | 44% | 38% | 18% | 800 | The polyethyleneimine of claim 1 |
| A3 | Polyethyleneimine | BASF | Lupasol | G20 | 39% | 36% | 25% | 1300 | The polyethyleneimine of claim 1 |

TABLE 1-continued

| Code | Resin name | Supplier | Product name | Product No. | Primary amino roup | Secondary amino group | Tertiary amino group | Molecular weight | Note |
|---|---|---|---|---|---|---|---|---|---|
| A4 | Polyethyleneimine | BASF | Lupasol | G35 | 38% | 36% | 26% | 2000 | The polyethyleneimine of claim 1 |
| A5 | Polyethyleneimine | BASF | Lupasol | G100 | 36% | 37% | 27% | 5000 | The polyethyleneimine of claim 1 |
| B1 | Polyethyleneimine | Nippon Shokubai | EPOMIN | SP-200 | 35% | 35% | 30% | 20000 | Molecular weight is higher than the upper limit |
| B2 | Polyethyleneimine | Nippon Shokubai | EPOMIN | SP-1000 | 25% | 50% | 25% | 75000 | Primary amino is less than the lower limit; Molecular weight is exceeding the upper limit |
| B3 | Polyethyleneimine | TOSOH | Straight chain pentaethylene-hexamine | | 33% | 67% | 0% | 204 | Tertiary amino is less than the lower limit; Molecular weight is less than the lower limit; straight chain |
| B4 | Polyallylamine | Nittobo | PAA | 01 | 100% | 0% | 0% | 1000 | Tertiary amino is less than the lower limit; not a polyethyleneimine |

TABLE 2

| E. and C.E. | Chemical conversion treatment solution | | | | | | | | | | | | | | Treatment temp. [° C.] |
|---|---|---|---|---|---|---|---|---|---|---|---|---|---|---|---|
| | Zr conc. [ppm] | Al conc. [ppm] | Al/Zr | Free F conc. [ppm] | Cu conc. [ppm] | Zn conc. [ppm] | Sn conc. [ppm] | pH | Polyethyleneimine Code | Primary amino | Tertiary amino | Molecular weight | Conc [ppm] | Ratio to Zr | |
| E. 1 | 60 | 40 | 67% | 6 | — | — | — | 4.8 | A1 | 35% | 30% | 600 | 17 | 28% | 45 |
| E. 2 | 100 | 50 | 50% | 10 | — | — | — | 4.0 | A2 | 44% | 18% | 800 | 10 | 10% | 30 |
| E. 3 | 100 | 50 | 50% | 10 | Cu: 20 | — | — | 4.0 | A2 | 44% | 18% | 800 | 10 | 10% | 30 |
| E. 4 | 200 | 100 | 50% | 20 | — | — | — | 4.0 | A3 | 39% | 25% | 1300 | 12 | 6% | 40 |
| E. 5 | 400 | 130 | 33% | 45 | — | — | — | 4.0 | A4 | 38% | 26% | 2000 | 80 | 20% | 40 |
| E. 6 | 100 | 280 | 280% | 20 | — | — | — | 4.0 | A5 | 36% | 27% | 5000 | 30 | 30% | 40 |
| E. 7 | 200 | 150 | 75% | 20 | — | — | — | 3.2 | A4 | 38% | 26% | 2000 | 15 | 8% | 40 |
| E. 8 | 200 | 150 | 75% | 20 | — | Zn: 1000 | — | 3.2 | A4 | 38% | 26% | 2000 | 15 | 8% | 40 |
| E. 9 | 300 | 0 | 0% | 30 | — | — | — | 4.0 | A3 | 39% | 25% | 1300 | 15 | 5% | 40 |
| E. 10 | 300 | 0 | 0% | 30 | — | — | Sn: 20 | 4.0 | A3 | 39% | 25% | 1300 | 15 | 5% | 40 |
| C.E. 1 | 40 | 130 | 325% | 10 | — | — | — | 5.2 | B2 | 25% | 25% | 75000 | 13 | 33% | 40 |
| C.E. 2 | 200 | 100 | 50% | 20 | — | — | — | 4.0 | B3 | 33% | 0% | 204 | 25 | 13% | 40 |
| C.E. 3 | 200 | 100 | 50% | 55 | — | — | — | 2.8 | B1 | 35% | 30% | 20000 | 50 | 25% | 40 |
| C.E. 4*** | 100 | 0 | 0% | 30 | — | — | — | 4.0 | B4 | 100% | 0% | 1000 | 500 | 500% | 40 |

| E. and C.E. | Steel strip | Zr coating weight [mg/m$^2$] | Coating performance: Electrodeposition coating: Corrosion resistance | Electrodeposition coating: Coating adhesion | Electrodeposition coating: Throwing power | Solvent coating: Corrosion resistance | Solvent coating: Coating adhesion |
|---|---|---|---|---|---|---|---|
| E. 1 | CRS* | 32 | B | A | A | A | A |
| | GA** | 25 | A | A | A | A | A |
| E. 2 | CRS | 28 | A | A | B | A | A |
| E. 3 | CRS | 40 | A | A | A | A | A |
| E. 4 | CRS | 41 | A | A | A | B | A |
| E. 5 | CRS | 62 | A | A | B | A | A |
| E. 6 | CRS | 34 | A | A | A | B | A |
| | GA | 29 | A | A | A | B | A |
| E. 7 | CRS | 23 | A | A | B | A | A |
| E. 8 | CRS | 26 | A | A | A | A | A |
| E. 9 | CRS | 34 | B | A | B | B | B |
| E. 10 | CRS | 25 | B | A | A | B | A |
| C.E. 1 | CRS | 26 | D | C | D | D | C |
| | GA | 21 | B | C | B | C | C |
| C.E. 2 | CRS | 48 | D | D | D | C | D |

TABLE 2-continued

| | | | | | | | |
|---|---|---|---|---|---|---|---|
| C.E. 3 | CRS | 16 | C | C | C | D | D |
| C.E. 4*** | CRS | 30 | C | D | D | C | D |

*CRS: cold rolled steel plate,
**GA: alloyed hot-dip galvanized steel plate,
***reproduction of Example 2 in the Patent literature 1,
Ex.: Example,
Comp. Ex.: Comparative Example,
conc.: concentration,
temp.: temperature.

The results demonstrate that, when a steel material is subjected to a chemical conversion treatment by using the chemical conversion treatment solution of the Example, the corrosion resistance after the coating and the coating adhesion are dramatically improved by the effect of the polyethyleneimine having the network structure for improving the quality of the chemical conversion coating. On the other hand, the results also reveal that such effect is insufficient when an amino group-containing resin other than polyethyleneimine or a polyethyleneimine having a straight chain structure is used.

Comparison between Example 3 with Example 2, Example 8 with Example 7, and Example 10 with Example 9 reveals that the throwing power of the chemical conversion treatment solution is improved when the solution contains a metal ion, namely, Cu, Zn, or Sn compared to the solution not containing such metal ion.

The invention claimed is:

1. A chemical conversion treatment solution comprising:
an acidic aqueous solution of pH 3 to 5 containing
50 to 500 ppm by weight of zirconium fluoride complex in terms of Zr,
5 to 50 ppm by weight of free fluorine, and
5 to 30% by weight in relation to Zr of polyethyleneimine, wherein the polyethyleneimine has a weight average molecular weight of 300 to 10,000 and the polyethyleneimine has a primary amino group, a secondary amino group, and a tertiary amino group and a molar ratio of the primary amino group in relation to total content of the primary, secondary and tertiary amino groups is at least 30% and a molar ratio of the tertiary amino group in relation to the total content of the primary, secondary and tertiary amino groups is at least 15%.

2. A chemical conversion treatment solution according to claim 1 wherein the chemical conversion treatment solution further comprises 30 to 300 ppm by weight of an aluminum fluorine complex in terms of Al and a weight ratio of Al to Zr in a range of 30 to 300%.

3. A chemical conversion treatment solution according to claim 1 wherein the chemical conversion treatment solution further comprises at least one metal ion selected from the group consisting of Zn, Sn, and Cu.

4. A chemical conversion treatment solution according to claim 2 wherein the chemical conversion treatment solution further comprises at least one metal ion selected from the group consisting of Zn, Sn, and Cu.

5. A method for conducting chemical conversion treatment of a steel material, comprising steps of
maintaining the chemical conversion treatment solution of claim 1 at 25 to 60° C.,
contacting a steel material with the chemical conversion treatment solution to thereby conduct a chemical conversion treatment for 1 to 300 seconds, and
rinsing the steel material with water.

6. A method for conducting chemical conversion treatment of a steel material, comprising steps of
maintaining the chemical conversion treatment solution of claim 2 at 25 to 60° C.,
contacting a steel material with the chemical conversion treatment solution to thereby conduct a chemical conversion treatment for 1 to 300 seconds, and
rinsing the steel material with water.

7. A method for conducting chemical conversion treatment of a steel material, comprising the steps of
maintaining the chemical conversion treatment solution of claim 3 at 25 to 60° C.,
contacting a steel material with the chemical conversion treatment solution to thereby conduct the chemical conversion treatment for 1 to 300 seconds, and
rinsing the steel material with water.

8. A method for conducting chemical conversion treatment of a steel material, comprising the steps of
maintaining the chemical conversion treatment solution of claim 4 at 25 to 60° C.,
contacting a steel material with the chemical conversion treatment solution to thereby conduct the chemical conversion treatment for 1 to 300 seconds, and
rinsing the steel material with water.

* * * * *